US010833439B2

(12) United States Patent
Wang et al.

(10) Patent No.: US 10,833,439 B2
(45) Date of Patent: Nov. 10, 2020

(54) ELECTRICAL CONNECTOR ASSEMBLY WITH MATED PLUG CONNECTOR AND RECEPTACLE CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Rui-Qin Wang, Kunshan (CN); Wei-Chou Lin, New Taipei (TW); Yu-Ke Chen, Kunshan (CN); Yen-Chih Chang, New Taipei (TW); Shih-Wei Hsiao, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/547,528

(22) Filed: Aug. 21, 2019

(65) Prior Publication Data

US 2020/0067221 A1 Feb. 27, 2020

(30) Foreign Application Priority Data

Aug. 21, 2018 (CN) ..... 2018 1 0953210

(51) Int. Cl.
*H01R 12/78* (2011.01)
*H01R 12/77* (2011.01)
(Continued)

(52) U.S. Cl.
CPC ..... *H01R 12/78* (2013.01); *H01R 12/774* (2013.01); *H01R 13/502* (2013.01); *H01R 13/6273* (2013.01); *H01R 13/648* (2013.01)

(58) Field of Classification Search
CPC .... H01R 12/78; H01R 12/774; H01R 13/516; H01R 12/79; H01R 13/6594; H01R 12/592; H01R 13/502; H01R 13/6273
(Continued)

(56) References Cited

U.S. PATENT DOCUMENTS 6,299,476 B1 * 10/2001 Schramme ..... H01R 12/774 439/492
6,315,616 B1 * 11/2001 Hayashi ..... H01R 12/79 439/108

(Continued)

FOREIGN PATENT DOCUMENTS

TW I271899 1/2007

*Primary Examiner* — Jean F Duverne
(74) *Attorney, Agent, or Firm* — Wei Te Chung; Ming Chieh Chang

(57) ABSTRACT

An electrical assembly includes mated plug connector and receptacle connector. The plug connector includes an insulative main body, a flat flexible cable attached upon the main body, a rotatable presser assembled upon the main body and retaining the flat flexible cable in position, and a metallic unitary latch assembled upon the main body with pair of resilient latches on two opposite lateral sides. Correspondingly, the receptacle connector includes an insulative housing, a plurality of contacts disposed in the housing, a metallic shell enclosing the housing, and a metallic cover attached upon the shell to shield the rear side of the receptacle connector.

20 Claims, 18 Drawing Sheets

(51) Int. Cl.
*H01R 13/648* (2006.01)
*H01R 13/627* (2006.01)
*H01R 13/502* (2006.01)

(58) Field of Classification Search
USPC ..... 439/357
See application file for complete search history.

(56) References Cited

U.S. PATENT DOCUMENTS 6,544,050 B1 * 4/2003 Ko ..... H01R 12/592 439/108
7,131,861 B2 * 11/2006 Aeschbacher ..... H01R 12/78 439/495
7,172,455 B2 * 2/2007 Pabst ..... H01R 12/78 439/496
8,858,249 B2 * 10/2014 Honda ..... H01R 13/648 439/260

* cited by examiner

ELECTRICAL CONNECTOR ASSEMBLY WITH MATED PLUG CONNECTOR AND RECEPTACLE CONNECTOR

BACKGROUND OF THE INVENTION

1. Field of the Invention

The present invention relates generally to an electrical connector assembly with mated plug connector and receptacle connector, and particularly to the plug connector having a mating tongue equipped with a flat flexible cable (FFC).

2. Description of Related Arts

Taiwan Invention Patent No. 1271899 discloses a cable connector equipped with a pair of latches, Anyhow, the traditional relatively large wires are used with the mating port of the connector, thus failing to perform a robust and miniaturized structures.

It is desirable to provide an electrical assembly with mated plug/cable connector and receptacle connector wherein the plug connector is equipped with an FFC for mating with the corresponding receptacle connector having the specific contact arrangement for mating and a superior shielding/grounding.

SUMMARY OF THE INVENTION

An electrical assembly includes mated plug connector and receptacle connector. The plug connector includes an insulative main body, a flat flexible cable attached upon the main body, a rotatable presser assembled upon the main body and retaining the flat flexible cable in position, and a metallic unitary latch assembled upon the main body with pair of resilient latches on two opposite lateral sides. Correspondingly, the receptacle connector includes an insulative housing, a plurality of contacts disposed in the housing, a metallic shell enclosing the housing, and a metallic cover attached upon the shell to shield the rear side of the receptacle connector.

DETAILED DESCRIPTION OF THE PREFERRED EMBODIMENT

Figure 1:
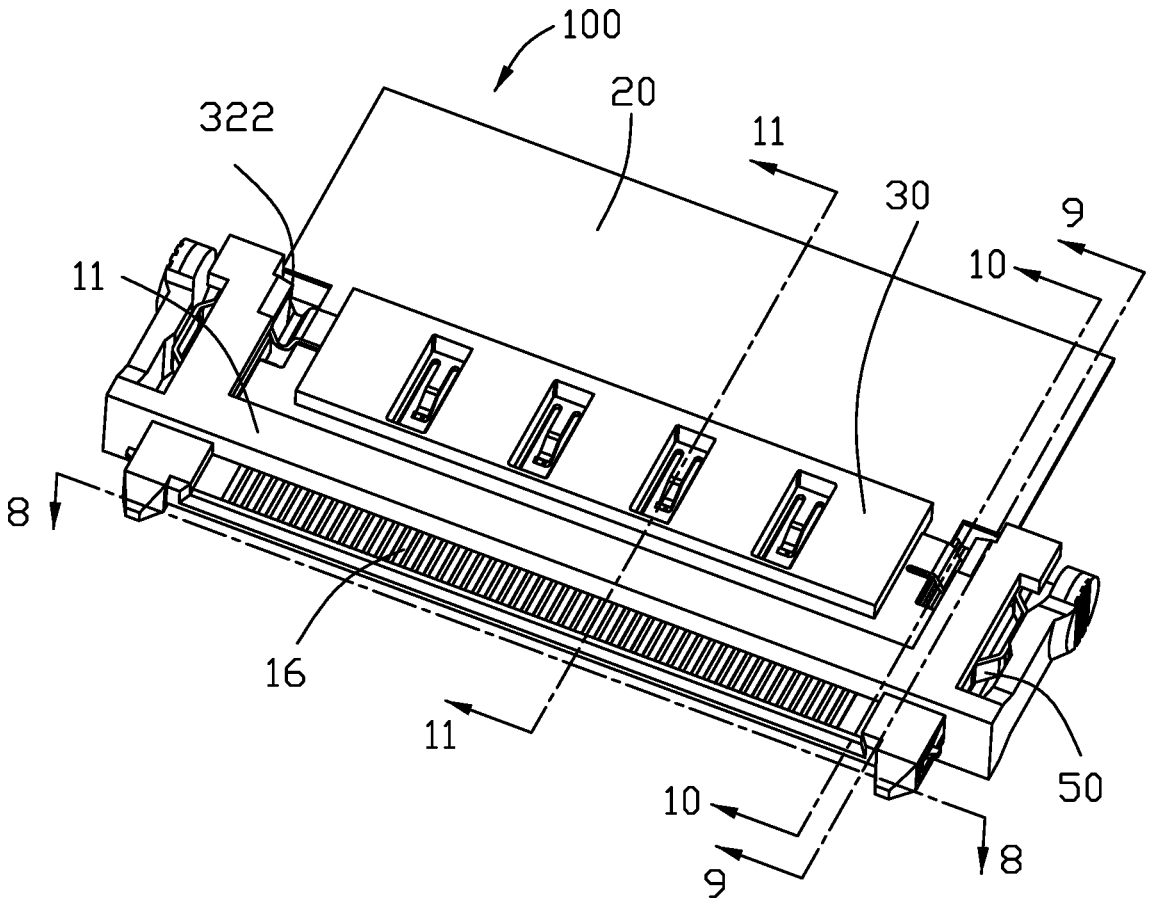
FIG. 1 is a perspective view of the plug connector of the electrical assembly according to the invention.

Referring to FIGS. 1-11 and 18, a plug/cable connector 100 is used for mating with a receptacle connector 600, 700 as shown in FIGS. 12-18. The connector 100 includes an insulative elongated main body 11 having a mating tongue 17 with contacting region 16 thereon. A flat flexible cable 20 is positioned upon the main body 11, a presser 30 is assembled upon the main body 11 and rotatable with regard to the main body 11 to press the cable 20 in position, and a metallic support plate 40 assembled within the main body 11 with a pair of latches 50 unitarily formed therewith.

The main body 11 includes a pair of deflectable operation parts 12 at two opposite ends for actuating the corresponding latches 50 for disengaging the latches 50 from the receptacle connector 600, 700. The presser 30 presses one side of the cable 20, and the metallic support plate 40 presses the other side oppositely.

The pair of latches 50 is directly bent unitarily from two opposite ends of the support plate 40. Each latch 50 includes a planar connecting section 51 linked to the support plate 40, a pressing section 52 and a locking section 53 having a hook 531 thereon. The support plate 40 further includes a stopper 43 to constrain the cable 20, and a restricting arm 44 to constrain the support plate 40 with regard to the main body 11. The support plate 40 further includes a main portion 41 and a pair of recessed portions 42. The pair of latches 50, the stoppers 43 and the restricting arm 44 all extend from the recessed portion 42. Notably, the stopper 43 lies in a plane perpendicular to the front-to-back direction while each of the restricting arm 44 and the connecting section 51 lies in a corresponding plane perpendicular to the transverse direction.

The main body 11 forms a space 110, and the metal support plate 40 is forwardly inserted into the space 110 to have the stopper 43 enter the space 110, the restricting arm 44 received within a corresponding slit (not labeled) in the main body 11, and the latch 50 forwardly extending with the corresponding hook 531 exposed outward and transversely in a front guiding posts (not labeled) while the pressing section 52 disposed transversely inside the operation part 12.

Figure 2:
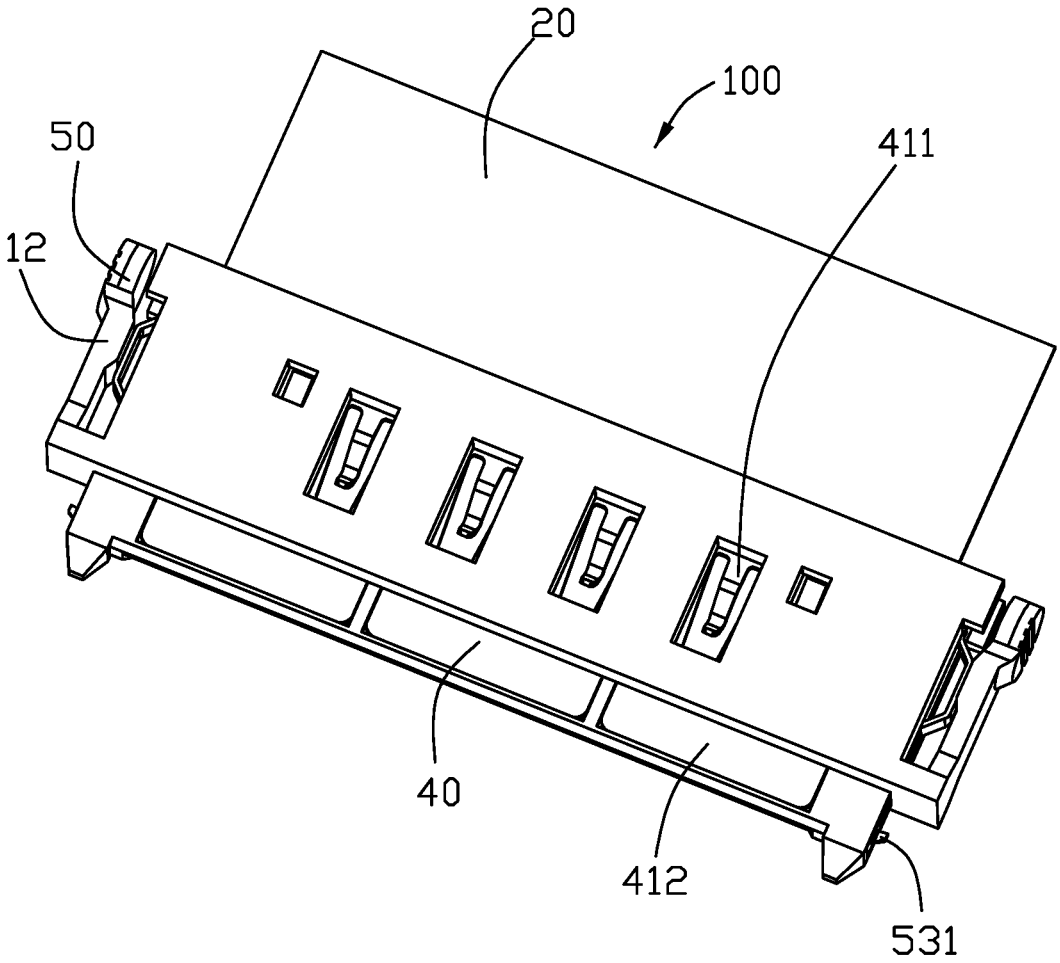
FIG. 2 is another perspective view of the plug connector of the electrical assembly of FIG. 1.
Figure 3:
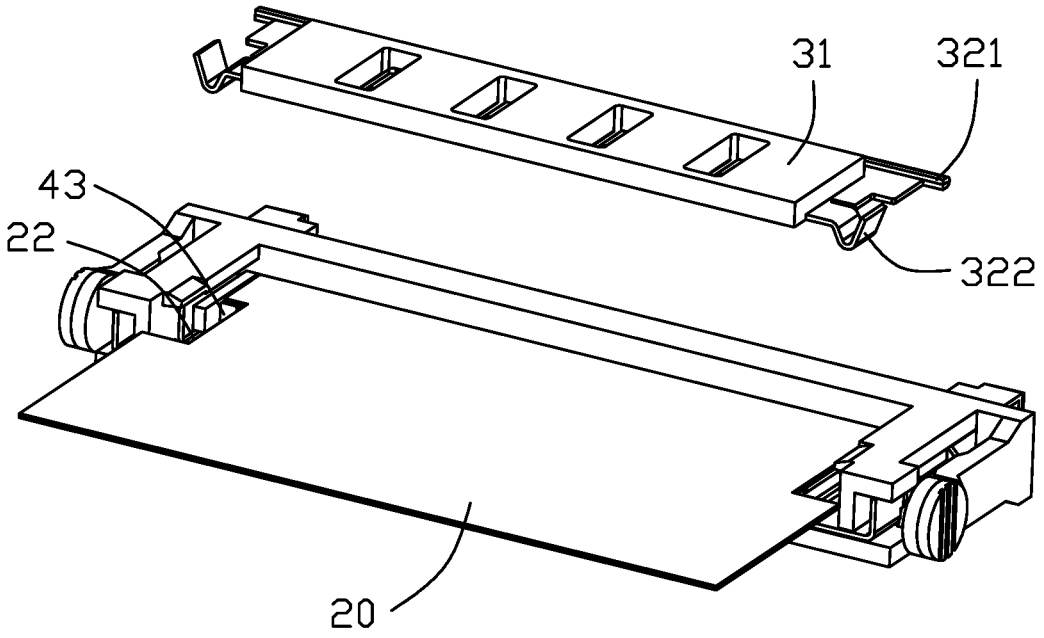
FIG. 3 is an exploded perspective view of the plug connector of the electrical assembly of FIG. 1.
Figure 4:
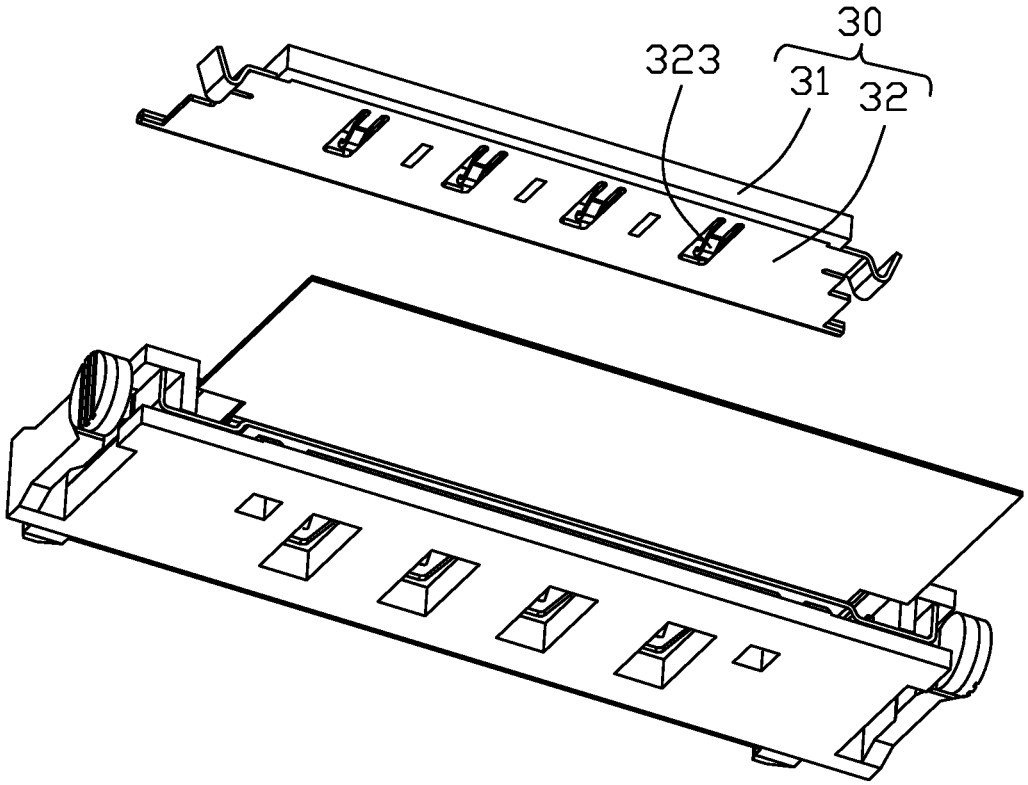
FIG. 4 is another exploded perspective view of the plug connector of the electrical assembly of FIG. 4.
Figure 5:
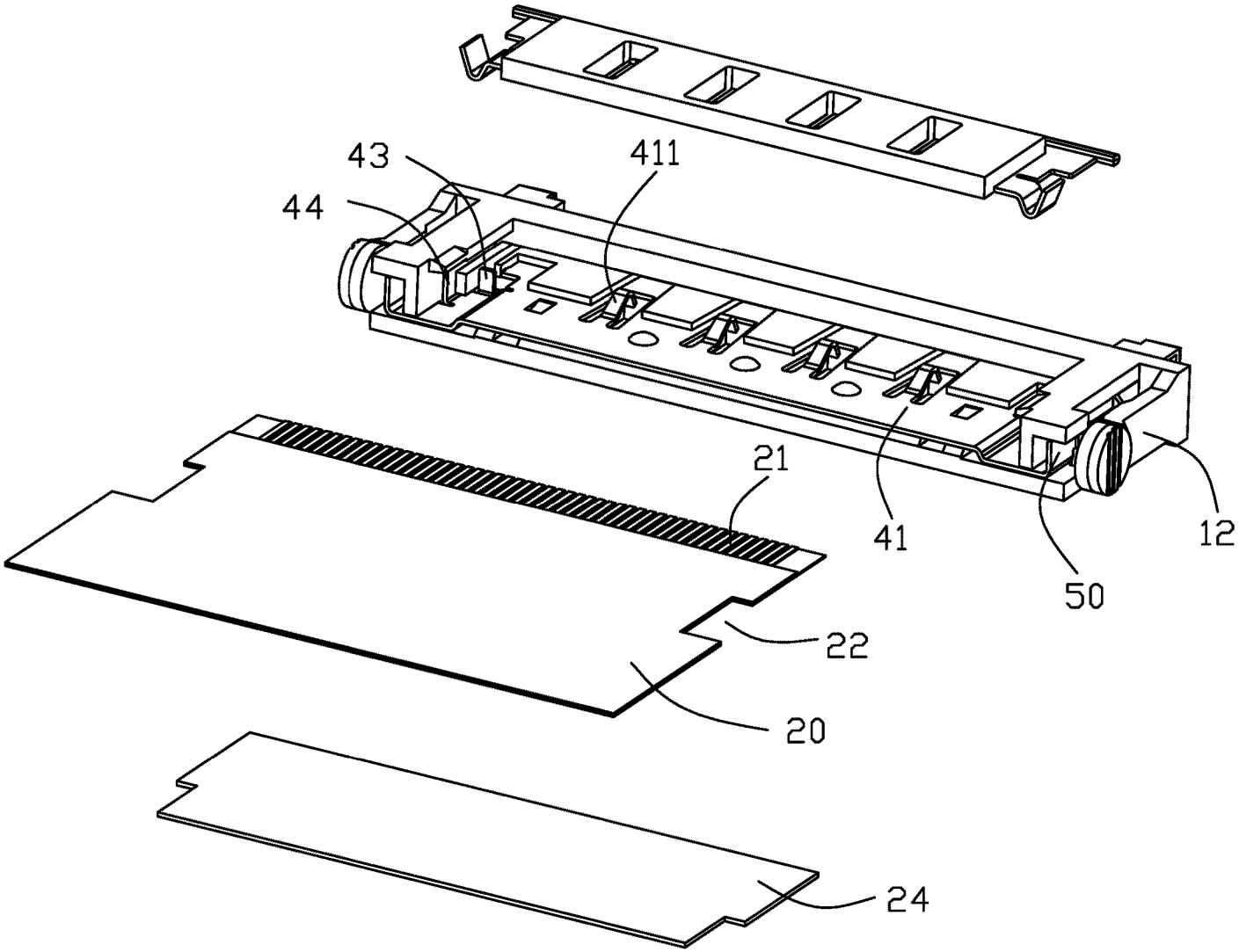
FIG. 5 is a further exploded perspective view of the plug connector of the electrical assembly of FIG. 3.
Figure 6:
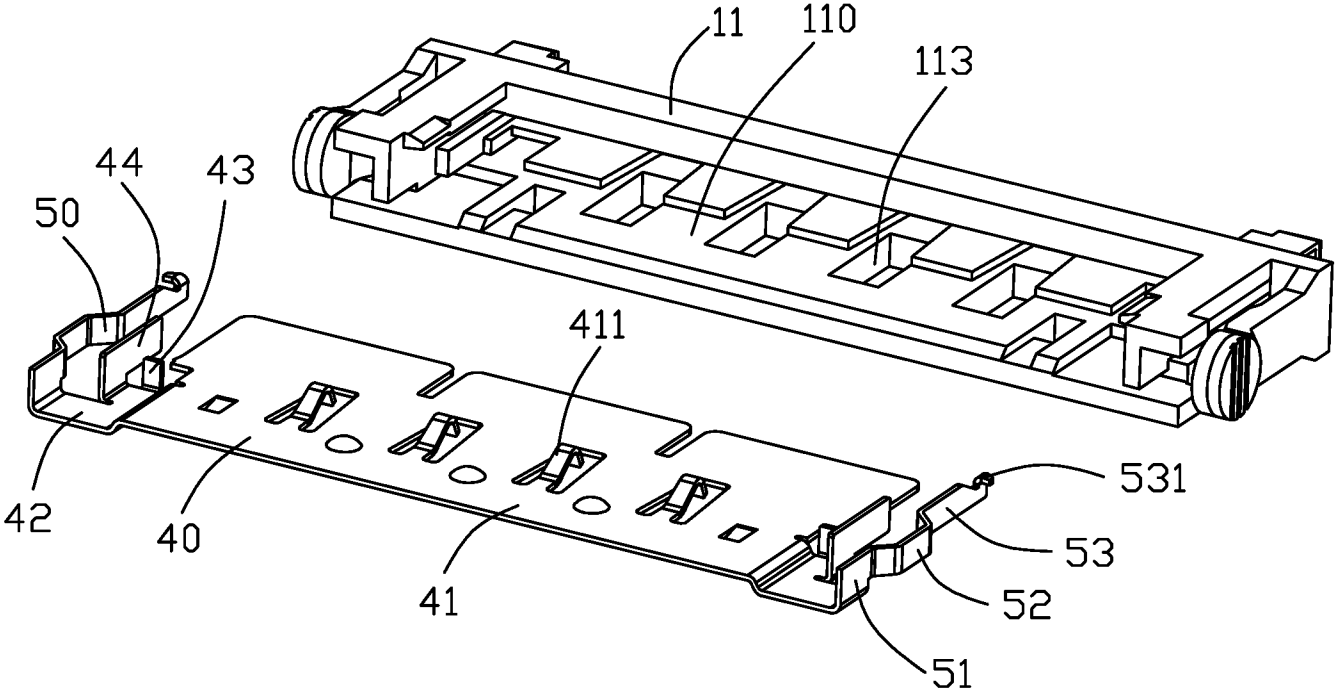
FIG. 6 is a further exploded perspective view of a portion of the plug connector of the electrical assembly of FIG. 5.
Figure 7:
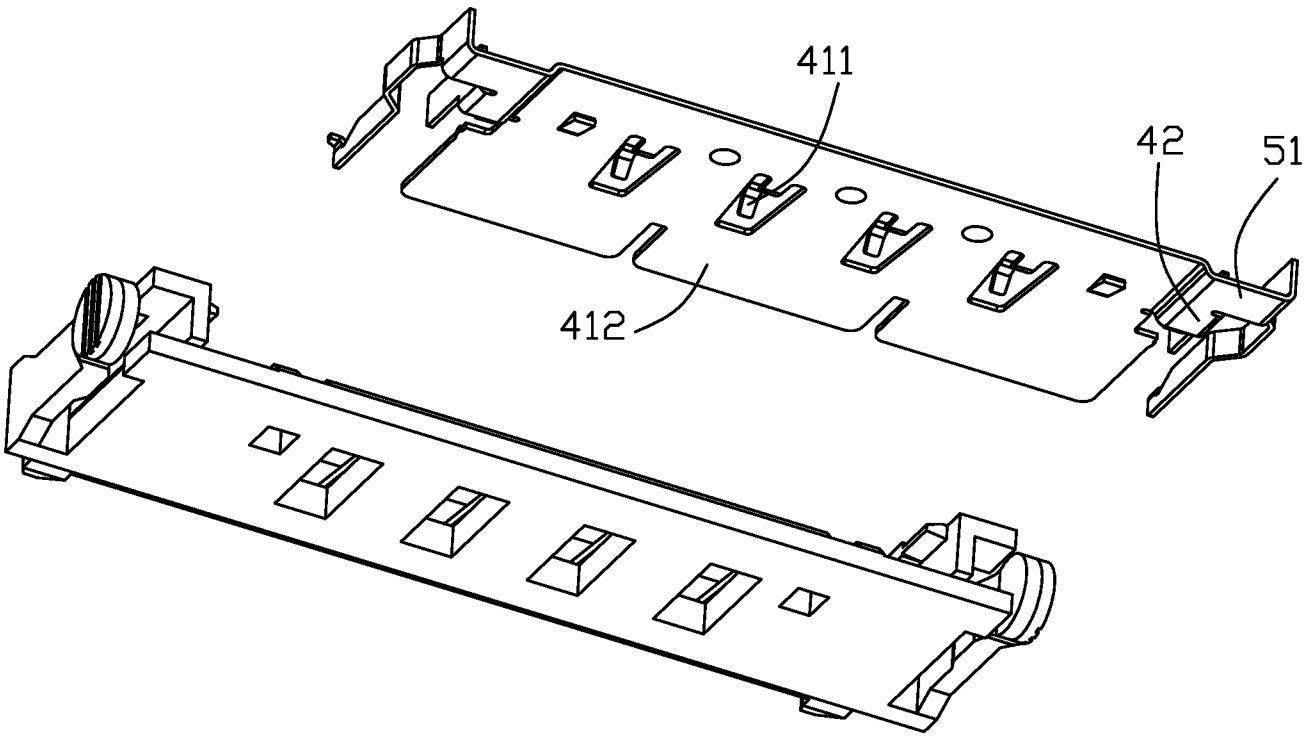
FIG. 7 is another exploded perspective view of the portion of the plug connector of the electrical assembly of FIG. 6.
Figure 8:
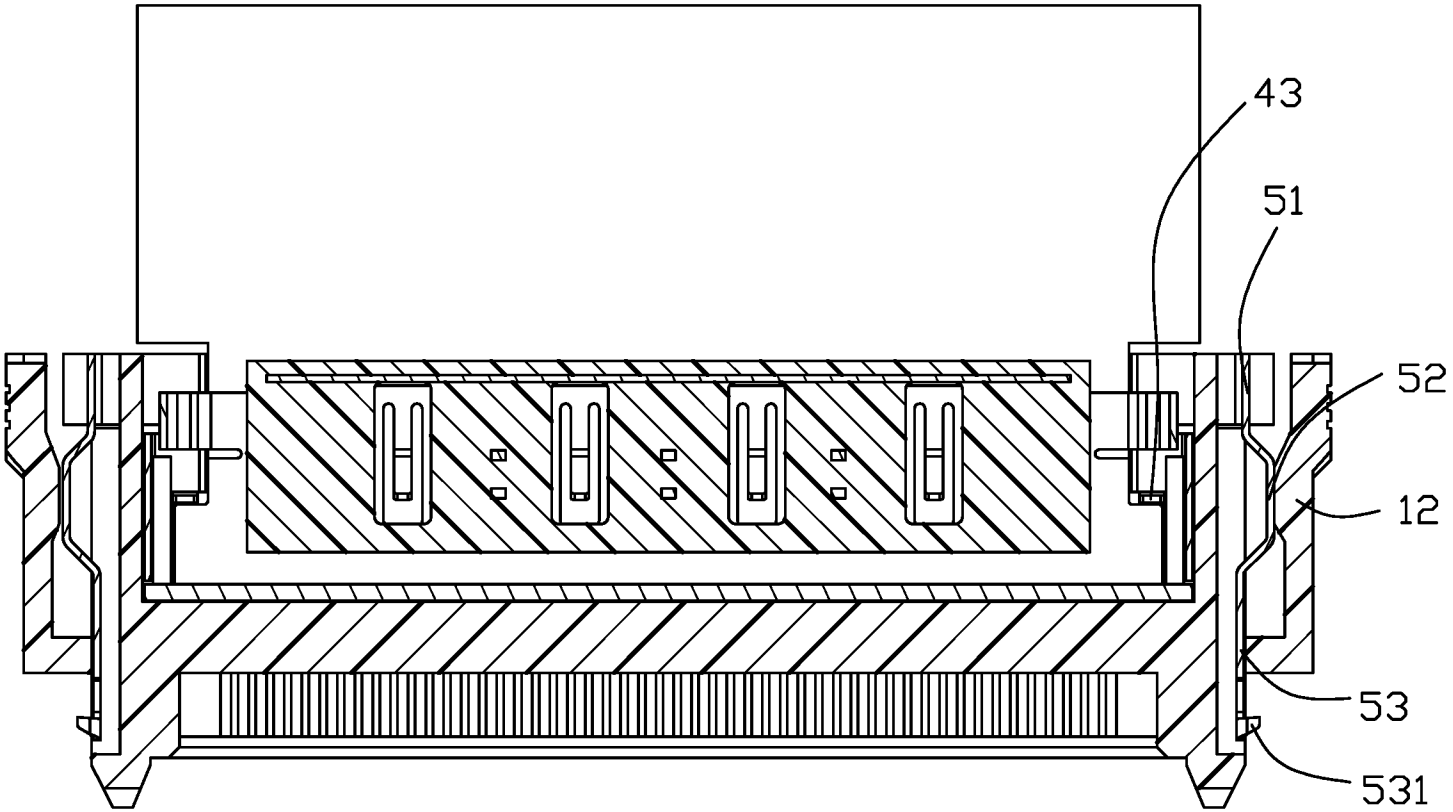
FIG. 8 is a cross-sectional view of the plug connector of the electrical assembly of FIG. 1 along line 8-8.
Figure 11:
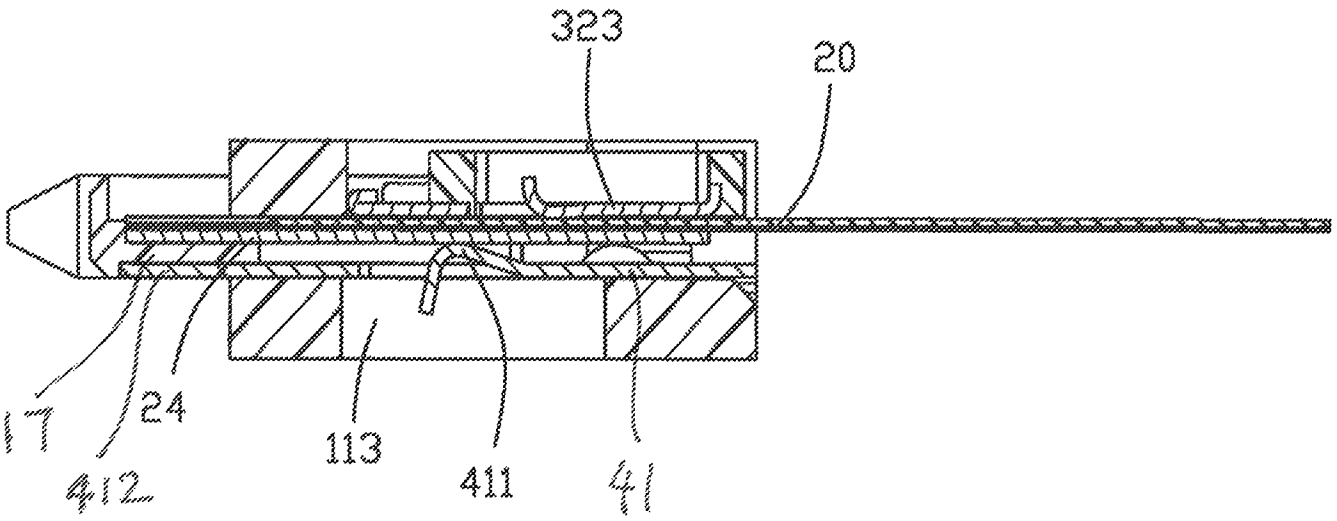
FIG. 11 is a cross-sectional view of the plug connector of the electrical assembly of FIG. 1 along line 11-11.
Figure 12:
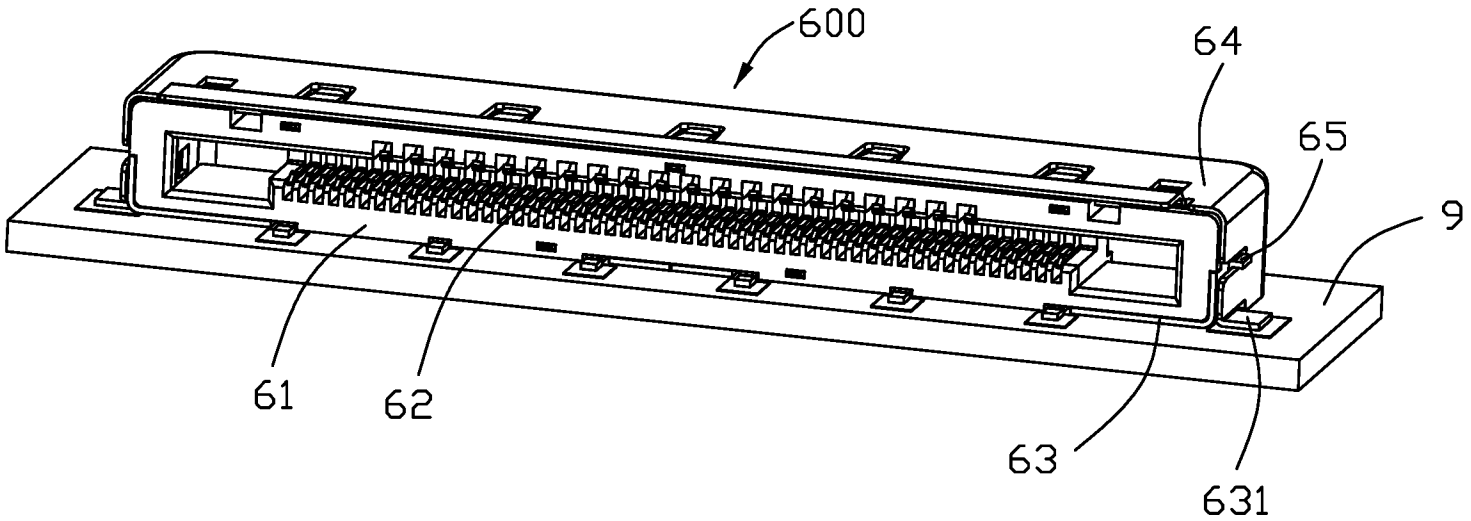
FIG. 12 is a perspective view of the receptacle connector, which is mounted upon a printed circuit board (PCB), of the electrical assembly according to the first embodiment of the invention.
Figure 13:
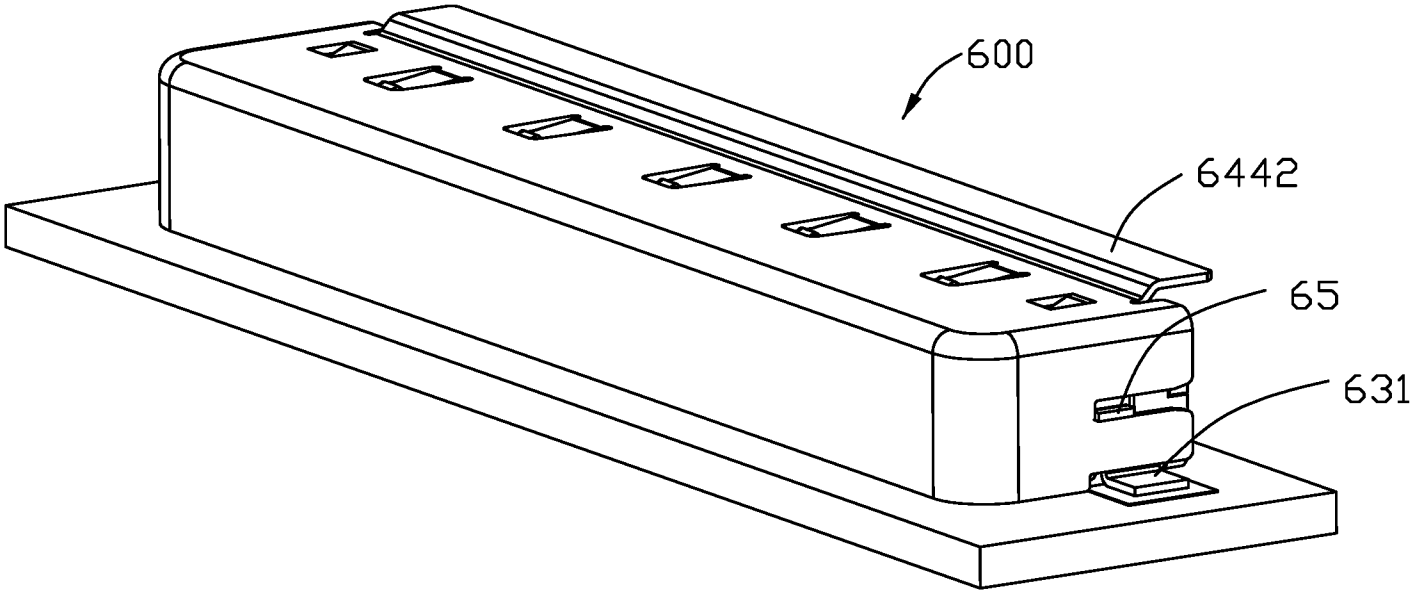
FIG. 13 is another perspective view of the receptacle connector, which is mounted upon the printed circuit board (PCB), of the electrical assembly of FIG. 12.
Figure 14:
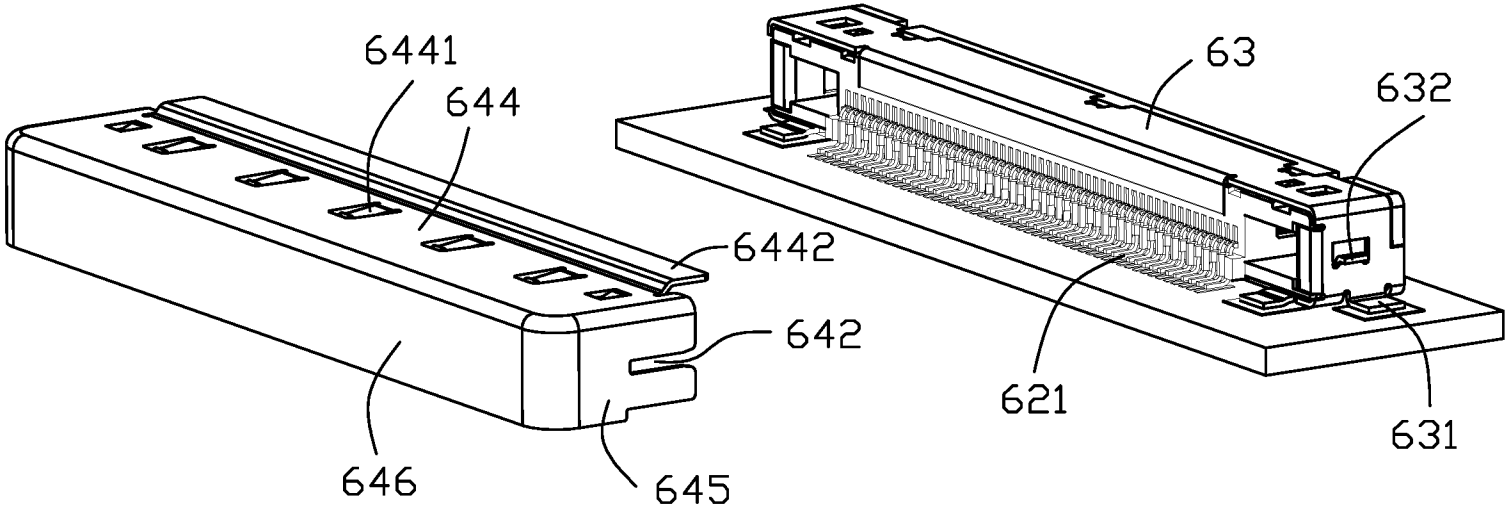
FIG. 14 is an exploded perspective view of the receptacle connector, which is mounted upon the printed circuit board (PCB), of the electrical assembly of FIG. 12.
Figure 15:
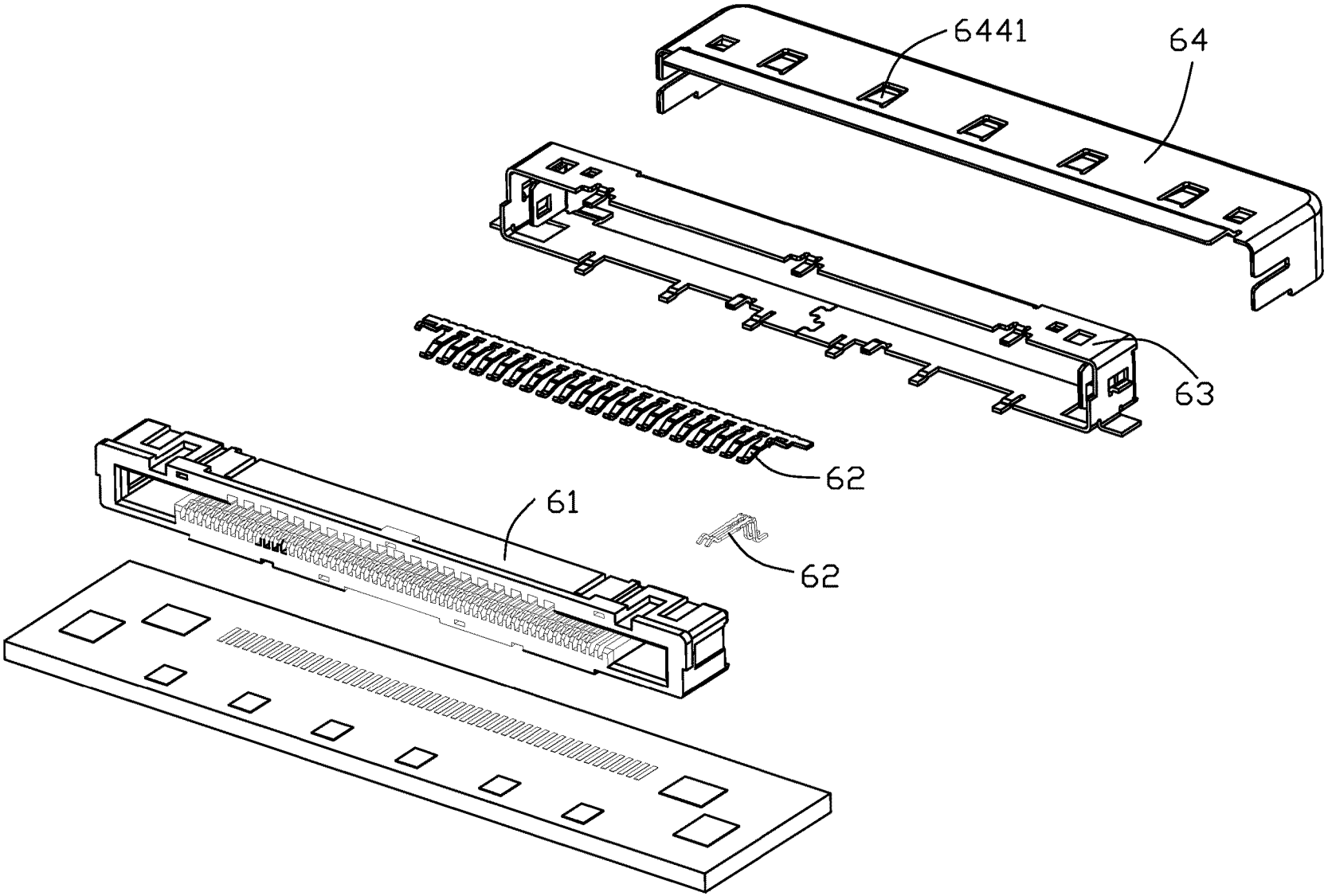
FIG. 15 is a further exploded perspective view of the receptacle connector, which is mounted upon the printed circuit board, of the electrical assembly of FIG. 14

The cable 20 is forwardly inserted into the space 110. Notably, the mating tongue 17 forms a shallow recess (not labeled) to receive the front end region of the cable 20, referring to FIG. 11. The cable 20 includes planar conductors 21 are exposed upon the contacting region 16. The main portion 41 abuts against the cable 20. As shown in FIGS. 2 and 11, the front region of 412 of the main portion 41 of the metallic support plate 40 is exposed upon the mating tongue 17 in the vertical direction. The main portion 41 includes a plurality of spring fingers 411 press the cable 20. Correspondingly, the main body 11 forms holes 113 to allow deflection of the spring fingers 411, as shown in FIG. 11, when the cable 20 is assembled into the space 110 and the presser 30 presses the cable 20 to hold the cable 20 in position in the main body 11.

The cable 20 forms a pair of notches 22 in two lateral sides of the front portion thereof. The stopper 43 abuts against the front/rearward edge (not labeled) of the cable 20 in the notch 22 for preventing rearward movement of the cable 20. Understandably, the cable 20 is assembled into the space 110 initially in a slightly tilted manner for not interfering with the stopper 43 and successively moved to the horizontal final position for backward engagement with the stopper 43.

Figure 9:
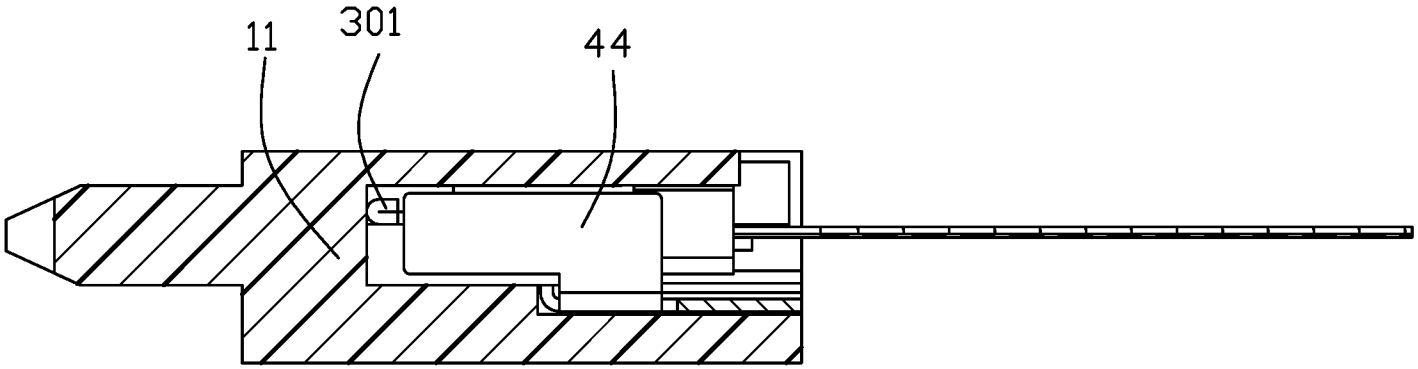
FIG. 9 is a cross-sectional view of the plug connector of the electrical assembly of FIG. 1 along line 9-9.
Figure 10:
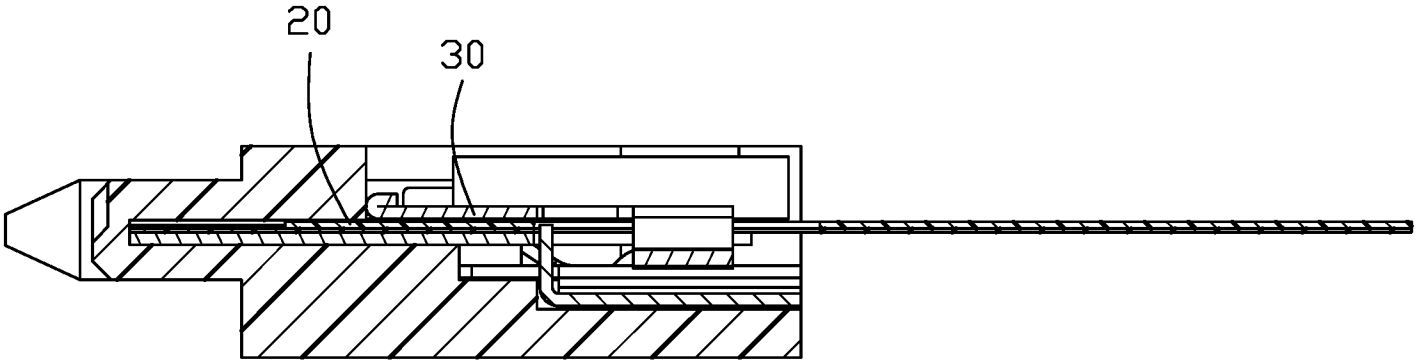
FIG. 10 is a cross-sectional view of the plug connector of the electrical assembly of FIG. 1 along line 10-10.

The presser 30 includes an insulative part 31 and a metallic part 32 embedded within the insulative part 31. The metallic part 32 includes a rotation shaft 321, a pair of securing sections 322 and a plurality of spring tangs 323. As shown in FIG. 9, the presser 30 is firstly assembled into the main body 11 and the support plate 40 is successively assembled into the main body 11 so as to have the restricting arm 44 forwardly abut against the shaft 321 for preventing withdrawal of the presser 30 from the main body 11. By rotation of the presser 30 toward the main body 11, the securing section 322 is received within the corresponding notch 22 for preventing backward movement of the cable 20. The free end of the securing section 322 engages the main body 11 so as to retain the presser 30 to the main body 11.

Notably, the cable 20 includes a metallic reinforcement plate 24 in the front portion so as to efficiently resist the forces derived from the spring fingers 411 of the support plate 40 and the spring tangs 323 of the presser 30 which are respectively press two opposite surfaces/sides of the cable 20, as shown in FIG. 11. Actually, the spring fingers 411 of the support plate 40 intimately press the reinforcement plate 24 while the spring tangs 323 of the presser 30 press the other side/surface of the cable 20.

Referring to FIGS. 12-15, the receptacle connector 600 mounted upon the printed circuit board 9 includes an insulative housing 61, two rows of contacts 62 retained in the housing 61, wherein the upper row of contacts for grounding are unified together via a crossbar (not labeled), and only two of the lower row of contacts for signal transmission are shown separately for illustration. A metallic shell 63 encloses the housing 61, and the metallic cover 64 attached upon the shell 63. The contact 62 forms a first mounting leg 621, and the shell 63 forms the second mounting leg 631 for mounting to the printed circuit board 9. The cover 64 is of a frame structure to enclose the first mounting legs 621 therein. A coupling 65 is formed between the shell 63 and the cover 64 for assembling the cover 64 to the shell 63, and is located adjacent to the corresponding second mounting leg 641 for lessening the grounding path. In this embodiment, the coupling 65 includes a tab 632 formed on the shell 63 and the slit 642 in the cover 64 so when the cover 64 is forwardly assembled to the shell 63 from the rear side, the tab 632 is received within the slit 642. The shell 64 includes a top wall 644, the side walls 645, the rear wall 646 wherein the slits 642 are formed in the side walls 645. The top wall 644 forms a plurality of spring arms 6441 to press the shell 63, and a flange 6442 for guiding mating between the plug connector 100 and the receptacle connector 600.

Figure 16:
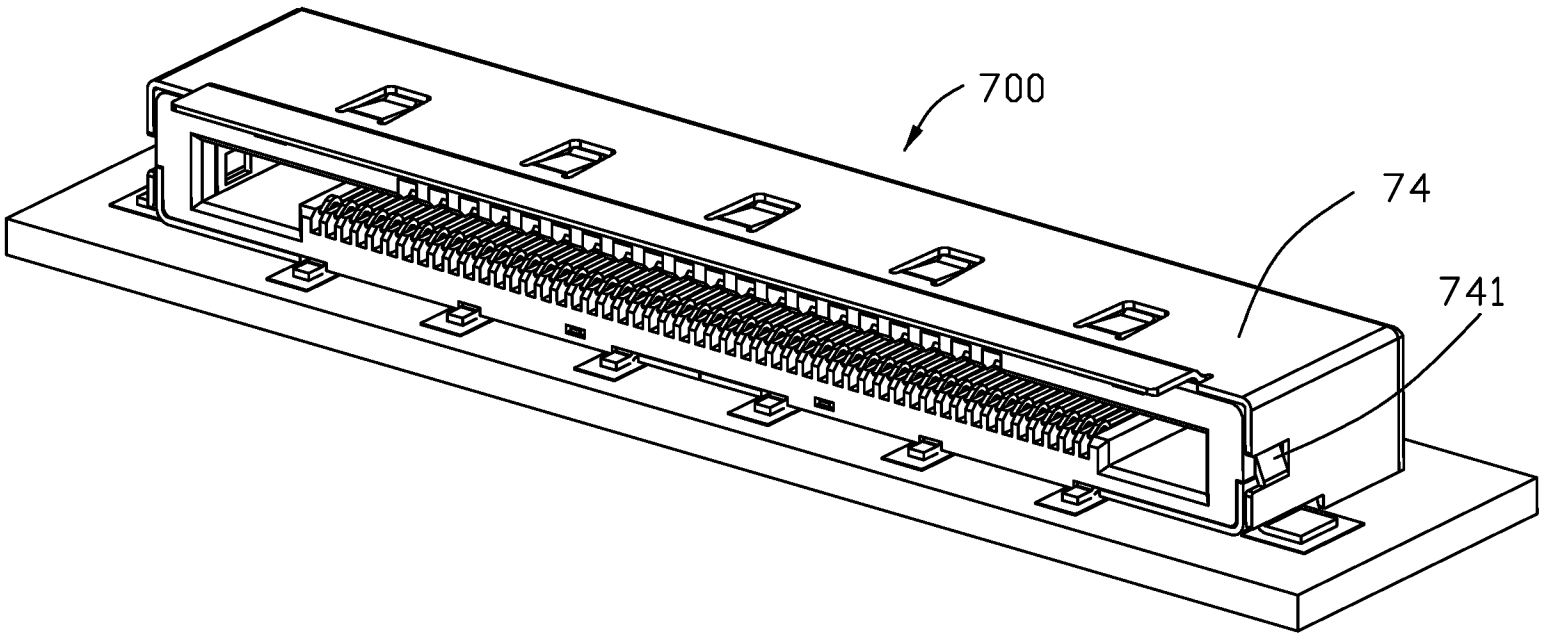
FIG. 16 is a perspective view of the receptacle connector of the electrical assembly according to the second embodiment of the invention.
Figure 17:
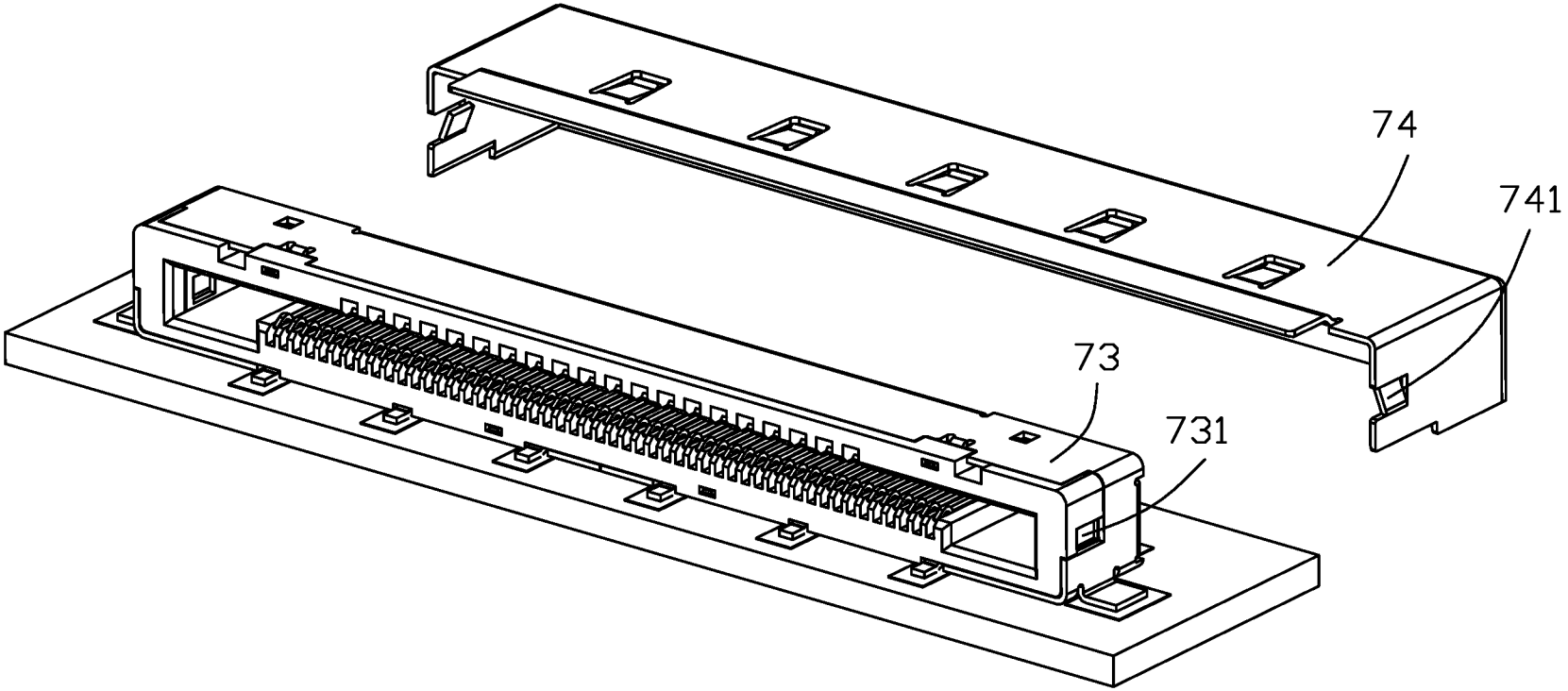
FIG. 17 is an exploded perspective view of the receptacle connector of the electrical assembly of FIG. 16.

FIGS. 16-17 show another embodiment of the receptacle connector 700, wherein the cover 74 is assembled downwardly to the shell 73 from the top side, and the coupling includes a spring tab 741 of the shell 74 and a recess 731 in the shell 73 to receive the spring tab 741.

Figure 18:
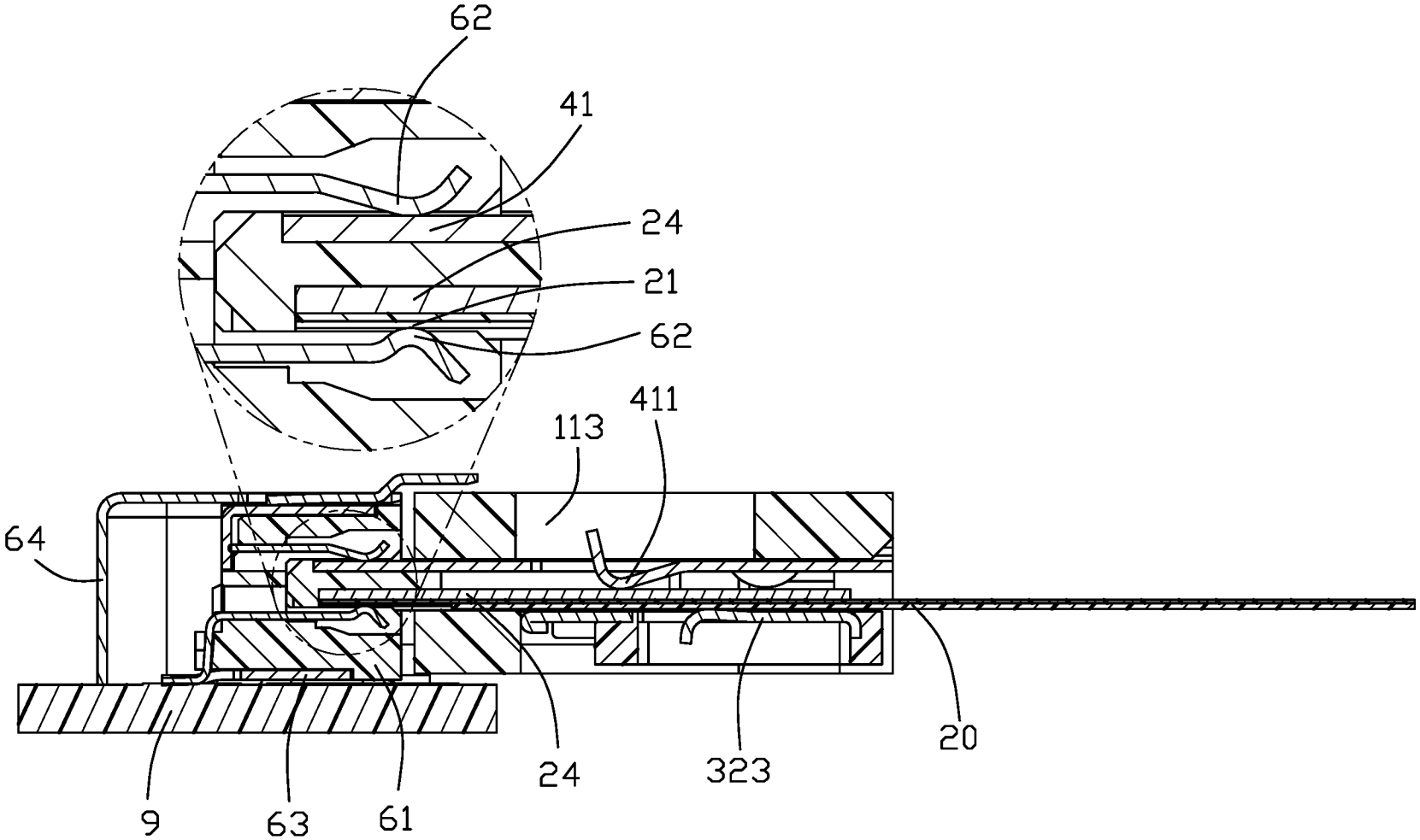
FIG. 18 is a cross-sectional view of the electrical connector with the mated plug connector and receptacle connector according to the invention.

As shown in FIG. 18, during mating the mating tongue 17 is located between the two rows of contacts 62 wherein the planar conductors 21 of the cable 20 are mechanically and electrically connected to the corresponding individual contacts 62 in the lower row for signal transmission while the respective contacts 62 in the upper row are mechanically and electrically connected to the main portion 41 of the support plate 40 for grounding. Via this arrangement, the shielding/grounding effect is maximized. It is also noted that the metallic shell 63 of the receptacle connector 600 forms a pair of locking holes (not labeled) inside the corresponding tabs 632 at two opposite ends in the transverse direction so as to be locked with the hooks 531 of the latches 50.

What is claimed is:

1. An electrical assembly comprising:

a plug connector adapted to be mated with a receptacle connector;

the plug connector including:

an insulative main body forming a mating tongue at a front end in a front-to-back direction;

a flat flexible cable assembled into the main body and including a metallic reinforcement plate and a plurality of conductors on two opposite surfaces thereof in a vertical direction perpendicular to the front-to-back direction; and a metallic support plate assembled to the main body to support the cable and mechanically and electrically connected to the metallic reinforcement plate;

the receptacle connector including:

an insulative housing;

two rows of contacts retained in the housing; wherein during mating, the conductors of the flat flexible cable of the plug connector are directly mechanically and electrically connected to the corresponding contacts of one row of the receptacle connector, and the metallic support plate of the plug connector is mechanically and electrically connected to the corresponding contacts of the other row of the receptacle connector for grounding.

2. The electrical assembly as claimed in claim 1, wherein said plug connector further includes a presser pressing the cable in position in the main body.

3. The electrical assembly as claimed in claim 2, wherein said presser and the support plate are respectively located by the two opposite surfaces of the cable to exert opposite forces thereon.

4. The electrical assembly as claimed in claim 3, wherein the presser has a plurality of spring tangs abutting against the corresponding surface of the flat flexible cable.

5. The electrical assembly as claimed in claim 3, wherein the metallic support plate has a plurality of spring fingers abutting against the metallic reinforcement plate.

6. The electrical assembly as claimed in claim 5, wherein the main body forms a plurality of holes to allow deflection of the corresponding spring fingers.

7. The electrical assembly as claimed in claim 2, wherein the presser is rotatable with regard to the main body, and the metallic support plate includes restriction arms to forwardly abut against a pivotal shaft of the presser.

8. The electrical assembly as claimed in claim 2, wherein said metallic support plate further includes unitarily a pair of deflectable latches located at two opposite ends in a transverse direction perpendicular to both the front-to-back direction and the vertical direction and moveable in the transverse direction for locking with the receptacle connector.

9. The electrical assembly as claimed in claim 8, wherein the main body includes a pair of deflectable operating parts outside of the corresponding latches for actuating said latches, respectively.

10. The electrical assembly as claimed in claim 2, wherein the metallic support plate forms restricting arm to prevent withdrawal of the presser.

11. The electrical assembly as claimed in claim 2, where flat flexible cable forms a pair of notches in two opposite lateral sides in a transverse direction perpendicular to both the front-to-back direction and the vertical direction, and at least one of the metallic support plate and the presser includes a portion received within the corresponding notch for preventing backward withdrawal of the flat flexible cable from the main body.

12. The electrical assembly as claimed in claim 11, wherein the presser includes an insulative part and a metallic part, and the metallic part forms the portion received within the corresponding notch.

13. The electrical assembly as claimed in claim 1, wherein the receptacle connector further includes a metallic shell enclosing the housing, and a metallic cover assembled to the metallic shell to cover a rear side of the housing.

14. A plug connector for use with a receptacle connector having two rows of contacts, comprising:

an insulative main body forming a mating tongue at a front end in a front-to-back direction;

a flat flexible cable assembled into the main body and including on two opposite surfaces thereof a metallic reinforcement plate, and a plurality of conductors adapted for mechanically and electrically connecting respectively to one row of contacts for signal transmission during mating;

a metallic support plate assembled to the main body to support the cable via mechanically and electrically connecting to the metallic reinforcement plate, and adapted for mechanically and electrically connecting to the other row of contacts for grounding during mating; and a presser assembled to the main body to press the flat flexible cable opposite to the metallic support plate in a vertical direction perpendicular to the front-to-back direction; wherein the metallic support plate is enclosed within the insulative main body except a front region of the metallic support plate being exposed upon the mating tongue in the vertical direction.

15. The plug connector as claimed in claim 14, wherein the metallic support plate forms a plurality of spring fingers abutting against the metallic reinforcement plate.

16. The plug connector as claimed in claim 15, wherein the presser forms a plurality of spring tangs abutting against the flat flexible cable opposite to the spring fingers in the vertical direction.

17. The plug connector as claimed in claim 14, wherein the flat flexible cable forms a pair of notches in two opposite lateral sides in a transverse direction perpendicular to both the front-to-back direction and the vertical direction, and at least one of the metallic support plate and the presser includes portions disposed in the notches for preventing backward withdrawal of the flat flexible cable from the main body.

18. The plug connector as claimed in claim 14, wherein said metallic support plate further unitarily includes a pair of deflectable latches located on two opposite lateral sides in a transverse direction perpendicular to both the front-to-back direction and the vertical direction and moveable in the transverse direction for locking with the receptacle connector.

19. A receptacle connector for use with a plug connector equipped with a flat flexible cable having a plurality of conductor exposed upon one surface and a metallic reinforcement plate on an opposite surface, said receptacle connector comprising:

an insulative housing;

two rows of contacts retained in the housing, one row of contacts being unified together by a crossbar for electrically connecting with the reinforcement plate during mating, and the other row of contacts for mechanically and electrically connecting to the respective conductors during mating;

a frame like metallic shell enclosing the housing; and a metallic cover discrete from the shell and attached upon the shell and shield a rear side of the housing; wherein a coupling is formed between the shell and the cover during assembling the cover to the shell, and said coupling is located adjacent to a pair of mounting legs which are mounted upon a printed circuit board on which the receptacle connector is seated.

20. The receptacle connector as claimed in claim 19, wherein the shell further includes a pair of locking holes for locking to a pair of corresponding deflectable latches on the plug connector, and said pair of locking holes are not exposed to an exterior in a transverse direction.

* * * * *